US005812045A

United States Patent [19]

Ishikawa et al.

[11] Patent Number: 5,812,045

[45] Date of Patent: Sep. 22, 1998

[54] INVERTER TRANSFORMER

[75] Inventors: Kazuhiro Ishikawa; Shigetoshi Watanabe; Minoru Nakano; Koji Ito, all of Tsurugashima, Japan

[73] Assignee: Toko, Inc., Japan

[21] Appl. No.: 766,413

[22] Filed: Dec. 12, 1996

[30] Foreign Application Priority Data

Dec. 15, 1995 [JP] Japan ..... 7-347614

[51] Int. Cl.[6] ..... H01F 27/02; H01F 27/30; H01F 17/04

[52] U.S. Cl. ..... 336/83; 336/198; 336/221; 336/208

[58] Field of Search ..... 336/208, 198, 336/221, 83

[56] References Cited

U.S. PATENT DOCUMENTS

| | | | |
|---|---|---|---|
| 3,287,678 | 11/1966 | Okamoto et al. | 336/83 |
| 3,675,174 | 7/1972 | Horbach | 336/198 |
| 4,745,388 | 5/1988 | Billings et al. | 336/83 |
| 4,800,356 | 1/1989 | Ellis . | |
| 4,891,620 | 1/1990 | Cheng . | |

FOREIGN PATENT DOCUMENTS

| | | | |
|---|---|---|---|
| 6-333688 | 2/1992 | Japan | 336/198 |
| 6-188132 | 7/1994 | Japan | 336/198 |
| 8-124772 | 5/1996 | Japan . | |

*Primary Examiner*—Michael L. Gellner
*Assistant Examiner*—Anh Mai
*Attorney, Agent, or Firm*—Londa and Traub LLP

[57] ABSTRACT

In an inverter transformer comprising a primary winding and secondary winding which are wound on a first and a second spool respectively and disposed in juxtaposing relationship-.with each other with the axes of the first and second spools being substantially parallel to each other, and a pair of cores which are disposed in abutting relationship to each other so as to define a closed magnetic path, the primary and secondary windings being electromagnetically coupled to each other through the pair of cores, at least one of said cores being provided with a protuberance which is disposed in opposing relationship to the other core, with a small distance maintained therebetween, the protuberance being interposed between the primary winding and the secondary winding, the arrangement is made such that secondary-side minimum sectional area of that portion of the cores through which magnetic flux is permitted to pass, is given substantially by $S_1$ K, where $S_1$ is primary-side minimum sectional area of that portion of the cores through which magnetic flux is permitted to pass, and K is the electromagnetic coupling coefficient between the primary winding and the secondary winding.

3 Claims, 4 Drawing Sheets

INVERTER TRANSFORMER

BACKGROUND OF THE INVENTION

1. Field of the Invention:

This invention relates to an inverter transformer adapted for use with an inverter for turning on an cold-cathode ray tube or the like which illuminates the back face of a liquid crystal display device.

2. Description of the Prior Art:

With some inverter circuit arrangement, there is a tendency that quantity of light of the cold-cathode ray tube increases when the electromagnetic coupling between a primary and a secondary winding of the inverter transformer is slightly reduced. Thus, there has conventionally been proposed such an inverter transformer as shown in FIG. 6 of the accompanying drawings, wherein a primary winding 1 and secondary winding 2 are disposed in side-by-side relationship with each other and a pair of cores 3 and 4 are disposed in abutting relationship with each other so that the primary and secondary windings 1 and 2 are electromagnetically coupled to each other; and the core 4 is provided with a protuberance 5 which in turn is interposed between the primary winding 1 and the secondary winding 2 so that the electromagnetic coupling therebetween is slightly reduced. By suitably selecting the height of the protuberance 5, it is possible to enhance the illuminating efficiency of the cold-cathode ray tube, while at the same time eliminating use of a ballast capacitor for the inverter circuit.

It is required that the aforementioned type of inverter transformer, which is predominantly used with portable devices, be constructed so as to be as compact as possible. However, it is also required that the number of turns of the secondary winding 2 be increased by the amount corresponding to the above-mentioned reduction of the electromagnetic coupling between the primary winding 1 and the secondary winding 2. The conventional construction is made such that the primary winding side and secondary winding side minimum cross-sectional areas of those portions of the cores 3 and 4 through which magnetic flux is permitted to pass, are substantially equal in dimension to each other, and thus disadvantageously, it turns out bulky as a whole.

In the above conventional construction, it is only that proportion of magnetic flux which corresponds to the magnetic flux passing through the primary winding-side portions of the cores 3 and 4 from which is subtracted the magnetic flux diverting to the protuberance 5 that passes through the secondary winding-side portions of the cores 3 and 4. Thus, that the primary winding-side and secondary winding-side minimum cross-sectional areas of the cores 3 and 4 are equal to each other means that the secondary winding-side cross-sectional areas of the cores 3 and 4 are wasted in terms of space.

SUMMARY OF THE INVENTION

The present invention has been made in view of the electromagnetic coupling coefficient between a primary and a secondary winding, and minimum cross-sectional area of core through which magnetic flux is permitted to pass. It is a primary object of the present invention to provide an inverter transformer which is so designed as to eliminate waste in the space at secondary side of the core Briefly stated, according to the present invention, there is provided an inverter transformer comprising a primary winding disposed in side-by-side relationship with each other; and a pair of cores disposed in abutting relationship with each other so as to form a closed magnetic path, the primary and secondary windings being electromagnetically coupled to each other through the pair of cores; at least one of the cores being provided with a protuberance, the protuberance being disposed in opposition to the other core, with an air gap defined therebetween, the protuberance being interposed between the primary and secondary windings, characterized in that at least one of said cores comprises a bottom plate and two spools extending perpendicularly from the bottom plate said primary winding is wound around one of the spools; the secondary winding is wound around the other spool; and a portion of the bottom plate to which the secondary winding opposes is made smaller in terms of thickness than a portion of the bottom plate to which said primary winding opposes.

According to another aspect of the present invention, the secondary winding-side minimum sectional area of a portion of said cores through which magnetic flux is permitted to pass, is given by $S_1$ (1−K), where $S_1$ is the primary winding-side minimum sectional area of the cores, and K is the electromagnetic coupling coefficient between said primary winding and the secondary winding; and wherein the secondary winding-side minimum sectional area of the portion of the cores through which magnetic flux is permitted to pass, is defined at the bottom plate. According to a further aspect of the present invention, the minimum sectional area of the protuberance is given by $S_1$ (1−K).

Other objects, features and advantages of the present invention will become apparent from the ensuing description taken in conjunction with the accompanying drawings.

DESCRIPTION OF THE PREFERRED EMBODIMENTS

Figure 1:
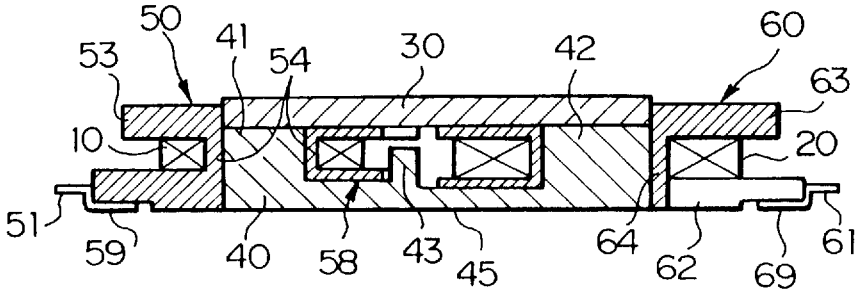
FIG. 1 is a front sectional view of the inverter transformer according to an embodiment of the present invention.
Figure 2:
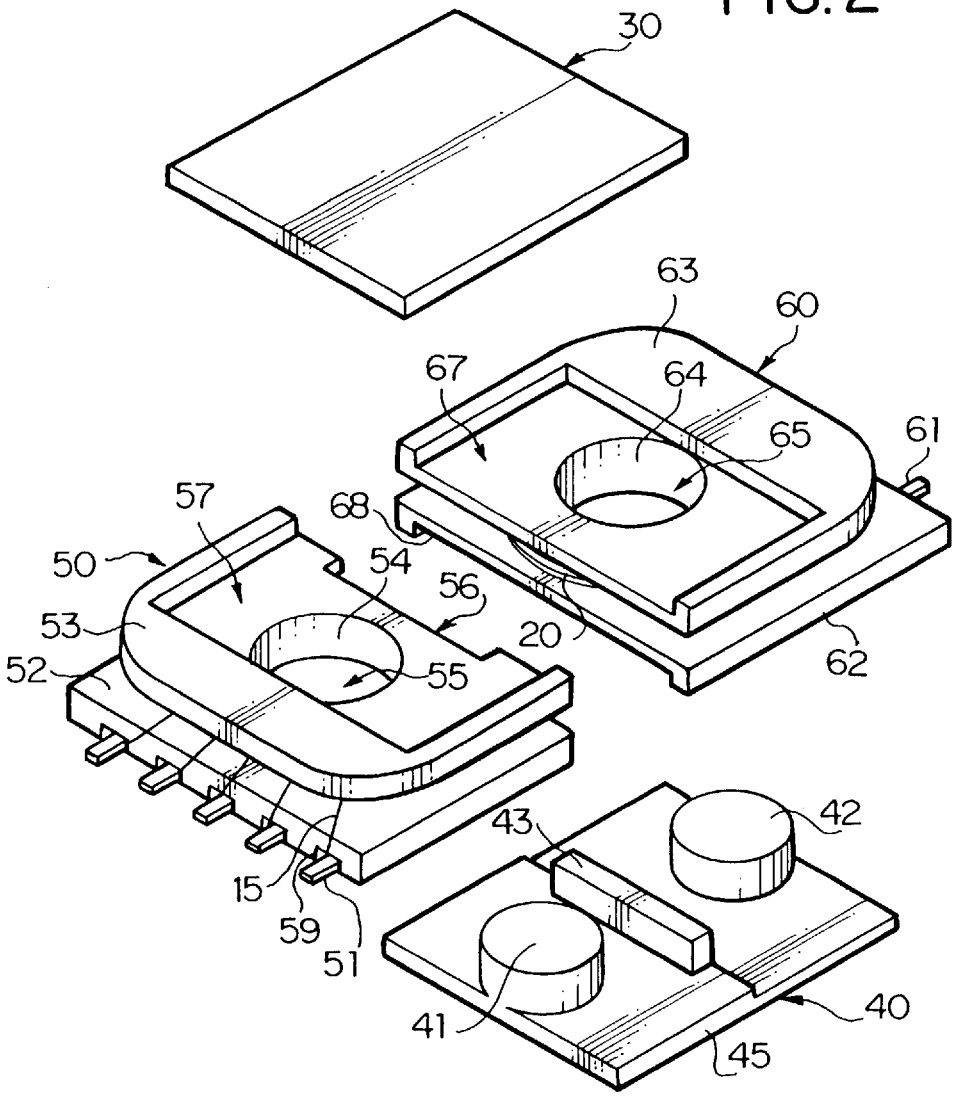
FIG. 2 is an exploded perspective view of the inverter transformer shown in FIG. 1.

Referring to FIGS. 1 and 2 of the accompanying drawings, an insulating bobbin 50 is provided which includes a base member 52 having terminals 51 planted in one side face thereof. The base member 52 is molded integrally with a cylindrical spool 54 having a flange 53. A hole 55 is formed through the bobbin 50 in such a manner as to extend through the spool 54. A recessed portion 56 is formed at that side face of the bobbin 50 which is opposite to the side where the terminals 51 are provided. The flange 53 is formed with a recess 57 by cutting out part of the upper surface thereof. The base member 52 is also formed with a recess 58 (FIG. 1) by cutting out part of the lower surface thereof.

A primary winding 10 at lower voltage is wound around the spool 54 of the bobbin 50; opposite lead wires 15 of the primary winding 10 are connected to different ones of the terminals 51 respectively; and lead wires led out of a tap of the primary winding 10 or the like are tied to the remaining ones of the terminals 51. Each of the terminals 51 includes an electrode portion 59 adapted for external connection, which is provided at the lower surface of the bobbin 50 and coupled to the respective terminal 51 inside the base member 52.

An insulating bobbin 60 is provided which is similar to the bobbin 50 and includes a base member 62 having terminals 61 planted in one side face thereof. The base member 62 is molded integrally with a cylindrical spool 64 having a flange 63. A hole 65 is formed through the bobbin 60 in such a manner as to extend through the spool 64. The flange 63 is formed with a recess 67 by cutting out part of the upper surface thereof. The base member 62 is also formed with a recess 68 by cutting out part of the lower surface thereof. A secondary winding 20 at a higher voltage is wound around the spool 64 of the bobbin 60, with lead wires thereof being connected to the respective ones of the terminals 61. Each of the terminals 61 also includes an electrode portion 69 adapted for external connection, which is provided at the lower surface of the bobbin 60 and coupled to a respective one of the terminals 61 inside the base member 62. The bobbins 50 and 60 are disposed in opposing relationship to each other at the side faces thereof which are opposite to the sides where the terminals 51 and 61 are provided, so that the primary winding 10 and secondary winding 20 are positioned in juxtaposing relationship with each other, with the axes of the spools 54 and 64 being substantially parallel to each other.

A pair of cores 30 and 40 are provided, each of which is formed of a magnetic material. The upper core 30 comprises a substantially flat plate-like core. The lower core 40 is provided at the opposite end portions thereof with two upwardly extending projections 41 and 42 which are integrally formed on a bottom plate 45. A protuberance 43, which is lower than the projections 41 and 42 is interposed therebetween. The projections 41 is inserted in the hole 55 of the bobbin 50; the projections 42 is inserted in the hole 65 of the bobbin 60; and the protuberance 43 is placed in engagement with the recessed portion 56, so that the core 40 is fitted onto the two bobbins 50 and 60 from bottom. The bottom plate 45 of the core 40 is accommodated in the recesses 58 and 68 of the bobbins 50 and 60 so that the bottom face of the core 40 becomes substantially flush with the bottom faces of the bobbins 50 and 60. The core 30 is mounted in the recesses 57 and 67 of the bobbins 50 and 60. The primary winding 10 and secondary winding 20 are electromagnetically coupled to each other through the pair of magnetic cores 30 and 40 which are disposed in abutting relationship with each other.

Figure 3:
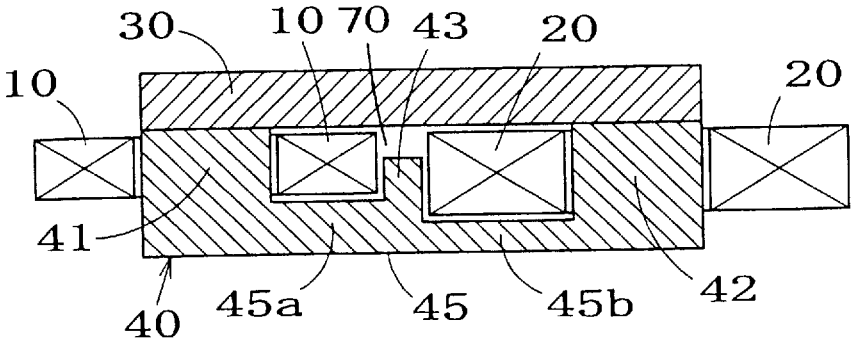
FIG. 3 is an enlarged front sectional view, schematically illustrating the main portion of the inverter transformer shown in FIG. 1.
Figure 7:
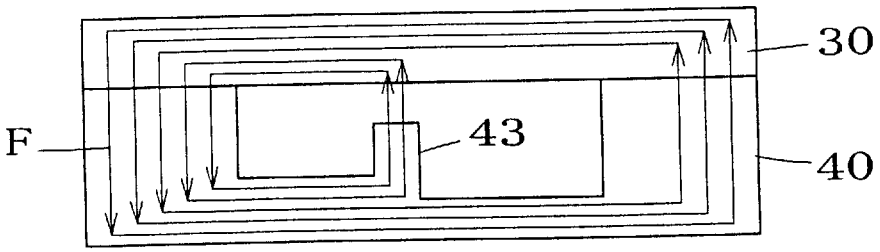
FIG. 7 is a schematic illustration of passage of magnetic flux through cores.

FIG. 3 schematically illustrates the main portion of the present inverter transformer, with the bobbins 50 and 60 being omitted. As can be seen, the protuberance 43 is disposed between the primary winding 10 and the secondary winding 20 in opposing relationship to the lower face of the upper core 30 with an air gap 40 to define therebetween. As the distance between the protuberance 43 and the core 30 is decreased, passage of magnetic flux through the protuberance 43 to the core 30 is facilitated; thus, by changing the protrusion extent or height of the protuberance 43 at the stage of designing the core 40, it is possible to to a desired value the degree of electromagnetic coupling between the primary winding 10 and the secondary winding 20. FIG. 7 is a schematic illustration of passage of magnetic flux through the cores 30 and 40.

Let it be assumed that the electromagnetic coupling coefficient between the primary winding 10 and the secondary winding 20 is K, and that magnetic flux passing through the primary sides of the cores 30 and 40 is $\phi$. Then, magnetic flux $K\phi$ will be caused to divert to the secondary sides of the cores 30 and 40, while magnetic flux $(1-K)\phi$ will be caused to divert to the protuberance 43 of the core 40. Thus, on the assumption that the primary winding-side minimum sectional area of that portion of the cores 30 and 40 through which magnetic flux is permitted to pass is $S_1$, the secondary winding-side minimum sectional area $S_2$ of that portion of the cores 30 and 40 through which magnetic flux is permitted to pass may be as small as $S_2=S_1\times K$, and the minimum sectional area of that portion of the protuberance 43 through which magnetic flux is permitted to pass may be as small as $S_1$ (1−K).

Thus, according to the present invention, the arrangement is made such that the secondary winding-side minimum sectional area S2 of that portion of the cores 30 and 40 through which magnetic flux is permitted to pass, is equal to the product of the primary-side minimum sectional area $S_1$ and coupling coefficient K, or $S_1$ K.

Figure 4:
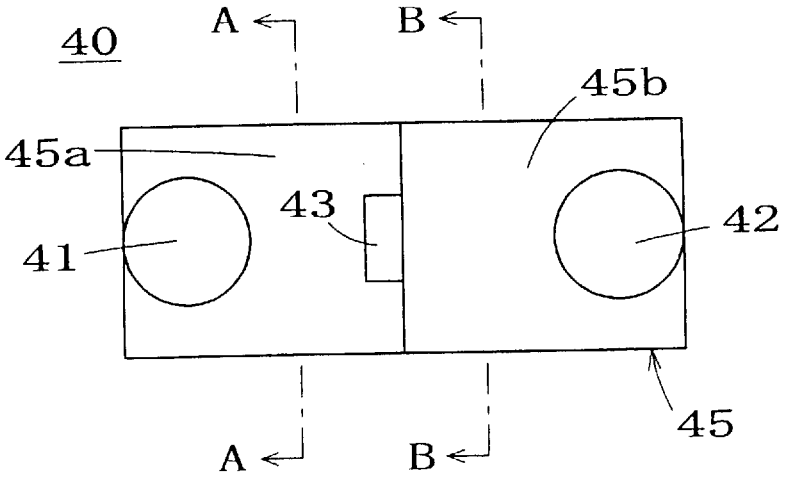
FIG. 4 is a plan view of a lower core incorporated in the inverter transformer.
Figure 8:
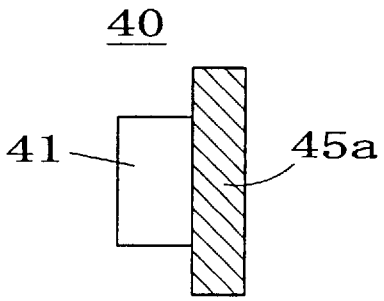
FIG. 8 is a sectional view taken along the lines A—A of FIG. 4.
Figure 9:
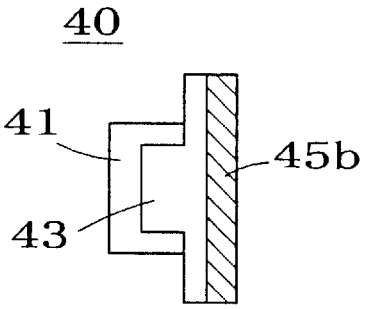
FIG. 9 is a sectional view taken along the lines B—B of FIG. 4.

The primary-side minimum sectional area $S_1$ is defined by the cross-section of the core 40 at the position corresponding to the lines A—A of FIG. 4, for example, which appears as a cross-section of the bottom plate portion 45*a* which is shown by hatching in FIG. 8. Furthermore, as can be seen from FIG. 3, bottom plate portion 45*b* to which the secondary winding 20 opposes, is made smaller in thickness than bottom plate portion 45*a* to which the primary winding 10 opposes; thus, the secondary winding-side minimum sectional area $S_2$ is defined by the cross-section of the core 40 at the position corresponding to the lines B—B of FIG. 4, which appears as a cross-section of the bottom plate portion 45*b* which is shown by hatching in FIG. 9. As will be appreciated, the space for accommodating the the secondary winding 20 is increased by the amount corresponding to the reduction in thickness of the bottom plate portion 45*b,* so that the number of turns of the secondary winding 20 can be increased without changing the external dimensions of the cores 30 and 40.

Figure 5:
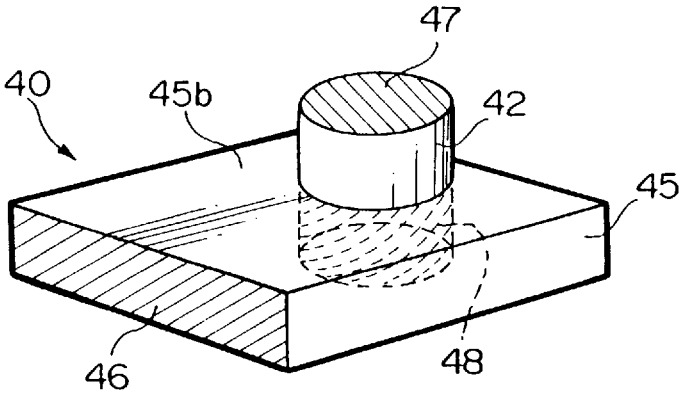
FIG. 5 is a partly sectional perspective view showing a portion of the lower core on an enlarged basis.
Figure 6:
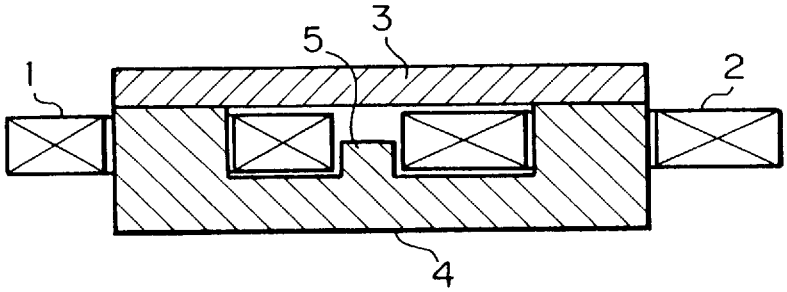
FIG. 6 PRIOR ART
FIG. 6 is a front sectional view showing the main portion of a conventional inverter transformer.

While in the above-described embodiment, the secondary winding-side minimum sectional area $S_2$ of that portion of the cores 30 and 40 through which magnetic flux is permitted to pass, is defined as a cross-section 46 of that bottom plate portion 45*b* of the lower core 40 to which the secondary winding 20 opposes, as shown in FIG. 5, it is possible that the secondary winding-side sectional area $S_2$ may be defined by a cross-section 47 of the spool 42 constituting the spool portion for the secondary winding 20. It is also possible that the secondary winding-side minimum sectional area $S_2$ may be defined by a cylindrical section 48 of the bottom plate portion 45 as taken along the extension of the peripheral surface of the spool 42. Further, to constitute the pair of cores, two cores having identical configuration, or E-shaped cross-section may be employed instead of the upper flat core 30 and the lower core 40 of E-shaped cross-section.

It will be appreciated from the foregoing discussion that according to the present invention, a waste in the space occupied by the secondary winding-side portion of the cores is eliminated so that the number of turns of the secondary winding is correspondingly increased in an inverter transformer in which the electromagnetic coupling between the primary winding and the secondary winding is slightly reduced; in this way, there is provided an inverter transformer which is improved in terms of space efficiency and small-sized.

While the present invention has been illustrated and described with specific embodiments thereof, it is to be understood that various changes and modifications thereto will become possible within the scope of the appended claims.

What is claimed is:

1. An inverter transformer comprising a primary winding and a secondary winding which are disposed in side-by-side relationship with each other; and a pair of cores disposed in abutting relationship with each other so as to form a closed magnetic path, said primary and secondary windings being electromagnetically coupled to each other through said pair of cores;

at least one of said cores being provided with a protuberance, said protuberance being disposed in opposing relationship to the other core, with an air gap defined therebetween, said protuberance being interposed between said primary and secondary windings, characterized in that;

at least one of said cores comprises a bottom plate and two projections extending perpendicularly from said bottom plate; said primary winding is provided around one of said projections; said secondary winding is provided around the other projection; and a portion of the bottom plate to which said secondary winding opposes is made smaller in terms of thickness than a portion of the bottom plate to which said primary winding opposes.

2. An inverter transformer according to claim 1, wherein a secondary winding-side minimum sectional area of a portion of said cores through which magnetic flux passes, is given by $S_1(1-K)$, where $S_1$ is a primary winding-side minimum sectional area of the cores, and K is an electromagnetic coupling coefficient between said primary winding and said secondary winding; and wherein the secondary winding-side minimum sectional area of the portion of said cores through which magnetic flux passes, is defined at said bottom plate.

3. An inverter transformer according to claim 2, wherein the minimum sectional area of said protuberances is given by $S_1(1-K)$.

* * * * *